United States Patent [19]

Samoilov et al.

[11] Patent Number: 4,723,367

[45] Date of Patent: Feb. 9, 1988

[54] INTERLOCKING EMBROIDERY HOOP

[76] Inventors: Constantin Samoilov, 285 Brandywine Ct.; Miguel N. Samoilov, 1100 Orchard La., both of Woodburn, Oreg. 97071

[21] Appl. No.: 839,502

[22] Filed: Mar. 14, 1986

[51] Int. Cl.[4] ..... D05C 1/04

[52] U.S. Cl. ..... 38/102.2; 38/DIG. 2; 160/380

[58] Field of Search ..... 160/380, 391, 395; 38/102.2, 102.1, DIG. 2; 403/322, 375, 365; 69/19.1, 19.2, 19.3; 248/121, 122, 126; 29/589; 269/289 R, 287

[56] References Cited

U.S. PATENT DOCUMENTS

| | | | |
|---|---|---|---|
| 699,263 | 5/1902 | Vosler | 38/102.2 |
| 989,597 | 4/1911 | Gibbs | 38/102.2 |
| 1,010,534 | 12/1911 | Totten et al. | 38/102.2 |
| 1,332,395 | 3/1920 | Hachmann | 403/365 X |
| 1,574,364 | 2/1926 | Carlson | 38/102.2 |
| 2,063,901 | 12/1936 | Wicander | 160/380 X |
| 2,198,128 | 4/1940 | Roberts et al. | 38/102.2 |
| 3,520,224 | 7/1970 | Hensley et al. | 403/379 X |
| 3,729,045 | 4/1973 | MacDonald | 160/380 X |
| 3,855,718 | 12/1974 | Parsons et al. | 38/102.2 |
| 4,644,639 | 2/1987 | Atteberry et al. | 38/102.2 X |

FOREIGN PATENT DOCUMENTS

| | | | |
|---|---|---|---|
| 1957248 | 5/1971 | Fed. Rep. of Germany | 160/380 |

*Primary Examiner*—Andrew M. Falik

*Attorney, Agent, or Firm*—Klarquist, Sparkman, Campbell, Leigh & Whinston

[57] ABSTRACT

An embroidery hoop comprises an inner ring and a split outer ring circumscribing the inner ring. The outer ring is adjustable in diameter relative to the inner ring to bring the inside surface of the outer ring into abutment with the outside surface of the innner ring. A ridge and a mating groove provided on the abutting surfaces prevent lateral displacement of the rings and thereby enable the fabric to be stretched across either side of the hoop and to be embroidered on either surface. The ridge and groove also urge the rings together as the fabric is pulled taut within the hoop, increasing the bite of the hoop upon the fabric. Legs may be affixed to one of the rings for supporting the hoop on a supporting surface during embroidery.

5 Claims, 5 Drawing Figures

FIG. 1
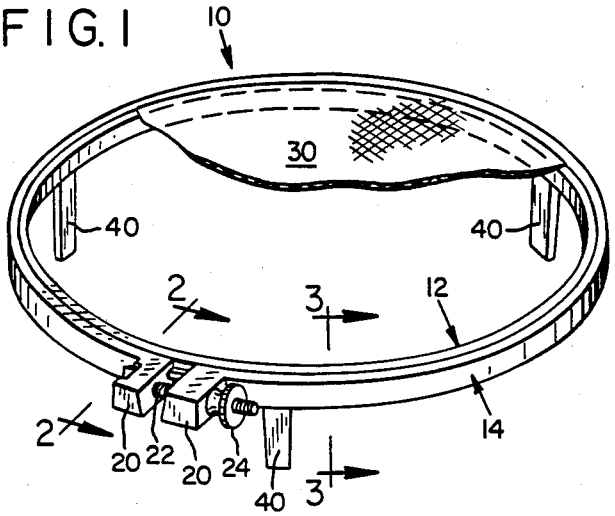
FIG. 2
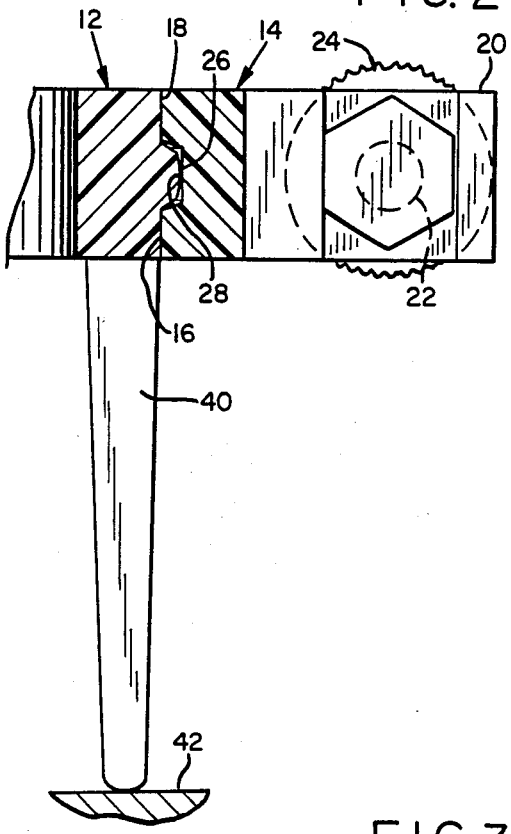
FIG. 4
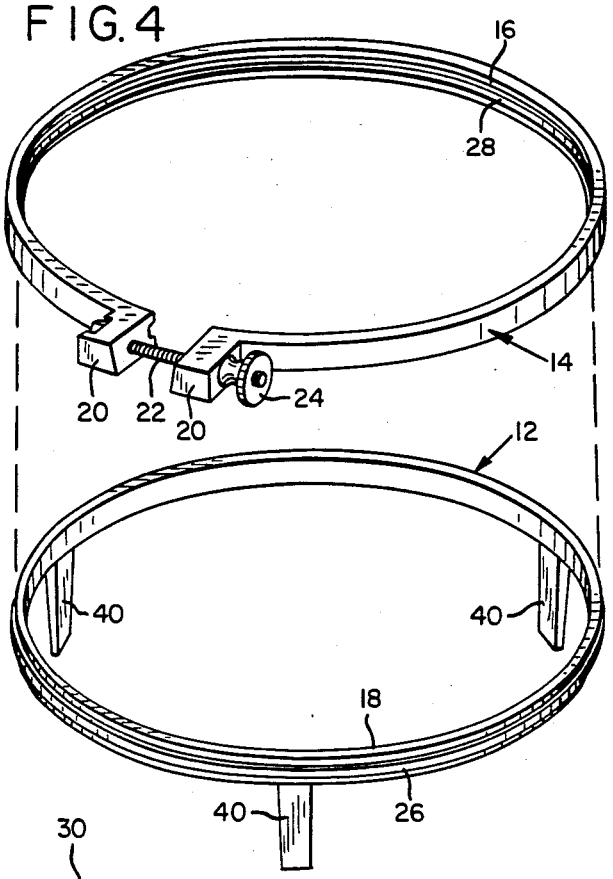
FIG. 3
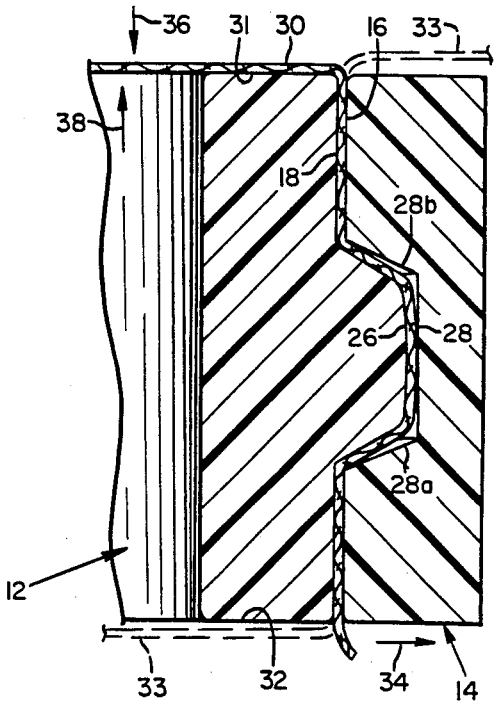
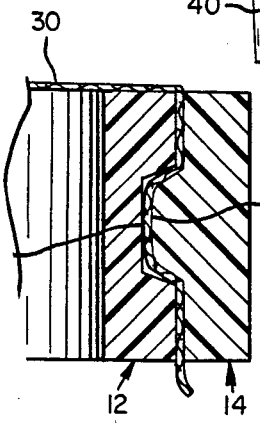
FIG. 5

INTERLOCKING EMBROIDERY HOOP

BACKGROUND OF THE INVENTION

This invention relates to embroidery hoops for embroidering fabric and more particularly to a hoop that increases the "bite" on the fabric as the fabric is pulled or pressed in the hoop, regardless of which side of the hoop the fabric is stretched across.

Embroidery hoops of the prior art have traditionally comprised concentric inner and outer rings, with the diameter of the outer ring adjustable to fit it snugly against the inner ring. To mount fabric to the hoop, the fabric is slipped between the outer and inner rings and pulled taut to form a drum-like surface. The outer ring is then tightened to hold the fabric under tension. Embroidery is performed by pressing a needle and thread through the taut fabric.

The rings of most hoops on the market, such as disclosed in U.S. Pat. No. 3,818,620 to Field et al., have smooth abutting surfaces between which the fabric passes. Pulling and pressing on the fabric while embroidering causes the rings to slide relative to one another, weakening the bite of the hoop on the fabric and allowing it to slip between the rings and slacken.

Recognizing this problem, several attempts have been made to strengthen the hoop's grip on the fabric by mounting a lip on the inner ring extending radially outward to overlie the upper surface of the outer ring. U.S. Pat. No. 2,957,269 to Nohl et al. shows such an embroidery hoop. The fabric is laid on the upper side of the outer ring, and the inner ring is then pressed down over the fabric as far as the lip allows. So long as the fabric is pressed only on its upper surface, the lip tends to press against the outer ring to keep the rings together. However, the lip is ineffective if the fabric is pressed on its lower surface. The lip also fails to urge the rings together if an attempt is made to pull the fabric taut.

U.S. Pat. No. 3,906,647 to Bates, Jr., uses a structure similar to that of Nohl et al. but mounts the fabric to the hoop in a different manner. Bates applies the fabric over the lip of the inner ring and then between the contiguous rings. Pulling on the fabric when mounted in this arrangement urges the two rings together. But Bates, like Nohl, is effective against pressure only on one surface of the fabric. Pressing against the lower fabric surface still tends to separate the rings. Both devices thus require the user to insert the fabric in a unique way and to embroider on a specific surface.

Another drawback of prior hoops is their instability. The hoop is held in one hand while the needle is pressed against the fabric with the other. A hand supporting a small portion of the hoop, however, cannot prevent the hoop from turning under the pressure of the other hand.

SUMMARY OF THE INVENTION

Therefore, an object of the invention is to provide an improved embroidery hoop that bites the fabric effectively and increasingly as the fabric is pushed or pulled no matter which surface of the fabric is pressed to embroider.

Yet another object of the invention is to provide a hoop that enables the fabric to be stretched across either side of the hoop.

Still another object of the invention is to provide a hoop with increased stability during embroidery as compared to prior hoops.

To achieve these objects, an embroidery hoop comprises an inner ring and a split outer ring circumscribing the inner ring, the outer and inner rings having abutting surfaces. Interlocking means on the abutting surfaces prevent lateral displacement of the rings. The interlocking means may comprise an annular ridge on one of the abutting surfaces and a mating annular groove provided in the other abutting surface. The ridge and groove interact to increase their bite on the fabric no matter which surface of the fabric is pressed during embroidery and also enable the fabric to be stretched across either side of the hoop with the same advantage. Legs may also be affixed to one of the rings for stabilizing the hoop on a supporting surface while the fabric is embroidered.

The foregoing and other objects, features, and advantages of the invention will become more apparent from the following detailed description of preferred embodiments which proceed with reference to the accompanying drawings.

BRIEF DESCRIPTION OF THE DRAWINGS

FIG. 1 is a perspective view of an embroidery hoop according to the invention.

FIG. 2 is a perspective view showing the two rings of the hoop of FIG. 1 separated from one another.

FIG. 3 is a cross-sectional view of FIG. 1 taken along line 3—3.

FIG. 4 is a magnified cross-sectional view of FIG. 1 taken along line 4—4.

FIG. 5 is a second embodiment of the hoop.

DETAILED DESCRIPTION

An embroidery hoop 10 according to the invention is shown in FIGS. 1 and 2. Hoop 10 comprises an inner ring 12 and a split outer ring 14 that circumscribes the inner ring. The rings 12, 14 may be made of any suitable, flexible material, such as plastic. Clamping means are mounted peripherally to the outer ring 14 for adjusting the diameter of the outer ring to bring its inside surface 16 into abutment with the outside surface 18 of the inner ring 12. These means may comprise a pair of opposing ears 20, each mounted on an end of the split outer ring 14, and also include a bolt 22 extending through coaxial apertures in each ear to be secured by a nut 24. Tightening the nut 24 on the bolt 22 urges the ears 20 and the rings 12, 14 together, thereby engaging the outer ring 14 snugly to the inner ring 12.

A means for interlocking the rings 12, 14 to prevent their lateral displacement is shown in detail in FIGS. 3 and 4. A male portion of the interlocking means such as a ridge 26 is provided on outside surface 18 of inner ring 12, with the female portion such as a mating annular groove 28 provided on the inside surface 16 of outer ring 14. It should be understood that the positions of the male and female portions can be reversed, as shown in FIG. 5, with the ridge 26 provided on the inside surface 16 of the outer ring 14 and the mating groove 28 provided on the outside surface 18 of the inner ring 12. Preferably the ridge 26 is annular and generally trapezoidal in cross section, with the angular sides of the ridge tapering inward equiangularly from the ridge base. It may extend circumferentially about the inner ring 12 along an intermediate portion of its outside surface 18, with the mating groove 28 of similar cross section formed in an intermediate portion of the inside surface 16 of outer ring 14. FIG. 3 shows a preferred size and location of ridge 26 relative to outside surface 18, with the ridge base no more than about one-half the width of the outside surface and the ridge running parallel to the plane 29 of inner ring 12. FIG. 3 also shows that the ridge 26 extends outward from ring 12 at least twice the thickness of fabric 30 stretched across the ridge.

The operation of the hoop 10 is apparent from FIG. 3. Because of the position of the ridge 26 and the mating groove 28 interior of the surfaces 16, 18, the fabric 30 can be stretched across the upper planar surface 31 of inner ring 12, as shown in the figure, or across the lower planar surface 32 as represented by dashed lines 33. In either arrangement the fabric 30 is gripped equally by the ridge 26 and groove 28. Once mounted, the fabric 30 is pulled taut within the hoop 10 as shown by arrow 34. This pulling urges the ridge 26 into a lateral side 28a of the mating groove 28 to grip the fabric 30 securely between rings 12, 14 and prevent their lateral displacement. In similar fashion, the ridge 26 is urged against the lateral side 28*b* to grip the fabric 30 if the feed of the fabric is reversed as represented by dashed lines 33. With the fabric 30 taut within the hoop, the nut 24 is tightened to urge the rings 12, 14 together and reinforce the grip on the fabric.

The ridge 26 and groove 28 also cooperate to bite or grip the fabric 30 as the user presses a needle against the fabric to embroider. Referring again to FIG. 4, pressing downward on the upper surface of the fabric as indicated by the arrow 36 urges the ridge 26 against lateral side 28*a* of groove 28. Pressing upwardly on the lower surface of the fabric as indicated by the arrow 38 urges the ridge 26 against lateral side 28*b* of groove 28. This engagement of the ridge 26 and groove 28 grips the fabric no matter which fabric surface pressure is applied against during embroidery.

Optionally affixed to one of the rings 12, 14 are a plurality of legs 40 shown in FIG. 3, here shown affixed to inner ring 12. The legs 40 extend transversely of the plane 29 to support the hoop 10 on a supporting surface 42 during embroidery. Thus, the user need not grip the outside edge of the hoop 10 as is normally done in an atempt to prevent its turning while pressure is applied to the fabric.

Having illustrated and described the principles of the invention in preferred embodiments, it should be apparent to those skilled in the art that the invention can be modified in arrangement and detail without departing from such principles. I claim all modifications coming within the spirit and scope of the following claims.

I claim:

1. An embroidery hoop for embroidering fabric thereon, comprising:

an inner ring having an outside surface;

a split outer ring circumscribing the inner ring, the outer ring having an inside surface;

a generally trapezoidal-shaped annular ridge whose angular sides taper inwardly from the base of the ridge and extending circumferentially about one of the rings, the ridge extending outward from the ring a distance at least twice the thickness of the fabric;

a mating annular generally trapezoidal-shaped groove within the other ring for receiving the ridge, and clamping means for adjusting the diameter of the outer ring to bring the ridge into clamping engagement with the groove, the ridge and mating groove being so sized and shaped that when the rings are clamped together the fabric can be pulled taught between the rings wherein the fabric is continuously gripped in a secure manner after it is pulled taught since the lateral sides of the trapezoidal-shaped ridge and groove coact to increase the gripping force against fabric extending therebetween upon the application of pressure to either side of the fabric portion stretched across the rings.

2. The embroidery hoop of claim 1 wherein the ridge is formed on the outside surface of the inner ring and the groove is formed on the inside surface of the outer ring.

3. The embroidery hoop of claim 1 including at least three legs extending transversely of the plane of the hoop from one of the rings for stabilizing the hoop on a supporting surface during embroidery.

4. The embroidery hoop of claim 3 wherein legs extend from the inside ring.

5. The embroidery hoop of claim 1 wherein the said angular sides of the trapezoidal-shaped annular ridge taper inward equiangularly from the ridge base.

* * * * *